US005355993A

United States Patent [19]

Hay

[11] Patent Number: 5,355,993

[45] Date of Patent: Oct. 18, 1994

[54] GROOVED DISK DRIVE APPARATUS AND METHOD FOR TRANSPORTING AND METERING PARTICULATE MATERIAL

[76] Inventor: Andrew G. Hay, 17244 S. Main St., Gardena, Calif. 90248-3130

[21] Appl. No.: 76,314

[22] Filed: Jun. 11, 1993

[51] Int. Cl.[5] ..... B65G 31/04

[52] U.S. Cl. ..... 198/642; 198/617

[58] Field of Search ..... 198/617, 638, 639, 642, 198/723; 406/96, 99; 222/311, 312, 414

[56] References Cited

U.S. PATENT DOCUMENTS

| | | | |
|---|---|---|---|
| 1,489,571 | 4/1924 | Wright . | |
| 1,668,183 | 5/1928 | Albrecht . | |
| 2,081,182 | 5/1937 | Malke et al. . | |
| 2,568,536 | 9/1951 | Beech | 198/642 |
| 2,712,412 | 7/1955 | West . | |
| 2,868,351 | 1/1959 | Hegmann . | |
| 3,592,394 | 7/1971 | Sinden . | |
| 3,643,516 | 2/1972 | Jacobson . | |
| 4,023,784 | 5/1977 | Wallace . | |
| 4,043,445 | 8/1977 | Wirth et al. | 198/642 X |
| 4,076,460 | 2/1978 | Roof . | |
| 4,516,674 | 5/1985 | Firth | 198/617 |
| 4,597,491 | 7/1986 | Conklin . | |
| 4,768,920 | 9/1988 | Gurth . | |
| 4,773,819 | 9/1988 | Gurth . | |
| 4,832,554 | 5/1989 | Gaskin | 222/414 X |
| 4,988,239 | 1/1991 | Firth | 198/617 X |
| 5,051,041 | 9/1991 | Firth | 198/617 X |

*Primary Examiner*—James R. Bidwell

*Attorney, Agent, or Firm*—Spensley Horn Jubas & Lubas

[57] ABSTRACT

An improved apparatus for transporting and metering particulate material including a transport duct having an inlet, an outlet, and at least one moving surface located therebetween having a downstream facing drive surface. The apparatus further includes a motive device for moving the moving surface between the inlet and the outlet towards the outlet. The particulate material being compacted sufficiently to cause the formation of a bridge composed of substantially interlocking particulates spanning the width of the transport duct. The bridging of the particulates causes the particulates to become semi-hydrostatic in nature such that the force exerted by the downstream facing drive surface upon particulates within the transport duct drives the entire mass of material through the transport duct towards the outlet. The apparatus is used to transport and meter particulate material under ambient conditions and against pressure.

25 Claims, 4 Drawing Sheets

GROOVED DISK DRIVE APPARATUS AND METHOD FOR TRANSPORTING AND METERING PARTICULATE MATERIAL

BACKGROUND OF THE INVENTION

1. Field of the Invention

The present invention relates generally to apparatus and methods for transporting and metering particulate material. More particularly, embodiments of the present invention are directed to a particulate material handling device which can be used to both transport and meter solid material of a great range of sizes under both ambient conditions and against pressure.

2. Description of Related Art

A wide variety of equipment has been used to either transport or meter particulate material. Such transport equipment includes conveyor belts, rotary valves, lock hoppers, screw-type feeders, etc. Exemplary measurement or metering devices include weigh belts, volumetric hoppers and the like. In order to provide both transport and metering of particulate material, it has generally been necessary to combine or incorporate both types of devices into a system.

One or more of the above identified transport or metering devices may be used in a solids transport system, depending upon a wide variety of parameters. For example, the amount, size and type of particulate material to be transported must be taken into consideration. The distance over which the solids are to be transported and variations in the surrounding pressure during transport must also be taken into account. The various transport and metering systems which are presently in use all have a variety of advantages and disadvantages which limit their performance in transporting or metering a wide variety of particulate types. It would be desirable to provide a single unit which is capable of simultaneously transporting and metering a wide variety of particulate materials under both ambient and pressurized conditions.

Large scale transport and/or metering of coal presents unique problems. A transport apparatus or system which is suitable for transporting one type of coal may not be suitable for transporting a different type of coal. For example, Kentucky coals maintain reasonable integrity when transported through conventional devices such as screw feeders and conveyor belts. However, Western United States coals tend to be more friable and may be degraded to a significant degree during normal transfer operations. It would be desirable to provide an apparatus which is capable of transferring all types of coal with a minimum amount of degradation.

The water content of the particulate solids is another factor which must be considered when designing any transport system. Many transport devices which are suitable for transporting completely dry particles do not function properly when the moisture content of the particulate material is raised. The same is true for particulate metering devices. Conventional metering devices which are designed to measure dry particulates are not well suited to meter moist solids. It would be desirable to provide a transport apparatus which is capable of moving and/or metering particulate solids regardless of their moisture content.

There are also many instances in which it is desirable to transport and meter particulate materials against pressure (e.g., wherein the pressure of the atmosphere and/or of fluids or solids at the output side of the transport system is greater than the pressure at the input side of the system). It would be desirable to provide an apparatus which is capable of simultaneously pumping and metering under both ambient pressure conditions and against a pressure head caused either by entry into a pressurized system or transport of the particulate material upward against gravity.

It is apparent from the above background that there is a present need for a solids handling or pumping device which operates as a single unit to provide simultaneous transport and metering of particulate material. The unit should be capable of transporting and metering a wide variety of particle types under a wide variety of conditions. Further, the unit should be structurally strong, and mechanically simple and durable so that it can be operated continuously over extended periods of time without failure.

SUMMARY OF THE DISCLOSURE

In accordance with embodiments of the present invention, an apparatus and method is provided for transporting and metering particulate materials with increased efficiency and reliability. The solids pump according to embodiments of the present invention is particularly suitable for transporting a wide range of particulate materials, including both small and large particulates and mixtures of them, having varying degrees of moisture content.

The present inventor has recognized that particulate material may be transported and metered through a transport duct defined by at least one downstream moving surface provided that the particulates have bridged across the duct to provide, in effect, a compacted transient solid spanning the width of the duct.

The present inventor has further recognized that particulate material which is bridged sufficiently to form, in effect, a transient solid spanning the width of a duct can be transported more efficiently against pressure by providing the downstream moving surface of the duct with at least one downstream facing drive surface for engaging the mass of compacted material.

Embodiments of the solids pump operate as a valveless positive displacement pump which provides accurate metering of particulates as well as transport under ambient conditions and against pressure.

The solids pump according to a preferred embodiment of the present invention includes a transport duct having an inlet, an outlet, and a primary transport channel between the inlet and outlet. The primary transport channel is defined by at least one moving surface which moves between the inlet and the outlet towards the outlet. The moving surface has at least one discontinuity having a downstream facing drive surface. The discontinuity defines a transport facilitation zone. The transport facilitation zone is contiguous with the primary transport channel such that particulate material within the transport facilitation zone is contiguous with particulate material within said primary transport channel.

Preferably, the particulate material is compacted or compressed prior to or upon entry into the pumping apparatus sufficiently to cause the formation of a transient solid or bridge composed of substantially interlocking particulates spanning the width of the primary transport channel and including particulates located within the transport facilitation zone. The briding occurs cumulatively toward the inlet of the appratus. This cumulative bridging may occur without the use of chokes or dynamic relative disk motion. However, further embodiments may include chokes or dynamic relative disk motion. Examples of such chokes and disk motions are described in U.S. Pat. Nos. 5,051,041; 4,988,239 and patent application Ser. No. 07/929,880 (each of which are assigned to the assignee of the present application and each of which are incorporated herein by reference). The bridging of particulates causes the particulates to become semi-hydrostatic in nature such that the force exerted by the downstream facing drive surface upon compacted particulates located within the transport facilitation zone drives the entire mass of material through the transport duct towards the outlet.

In a preferred embodiment of the present invention, the solids pump includes a housing having an inlet and an outlet. Enclosed within the housing is a transport duct extending between the inlet and outlet. The transport duct is formed between substantially opposed faces of first and second rotary discs movable relative to said housing between the inlet and outlet towards the outlet and at least one arcuate wall extending between the inlet and outlet.

As an additional feature of the above-described embodiment of present invention, the opposing faces of the rotary discs include at least one discontinuity, and preferably a plurality of evenly spaced radially extending discontinuities which define the transport facilitation zones. In a preferred embodiment, each discontinuity has a downstream facing drive surface, an upstream facing surface positioned downstream of the downstream facing surface, and a bottom area contiguous with the downstream facing drive surface and the upstream facing surface.

As yet another feature of a preferred embodiment of each rotary disc described above, each downstream facing drive surface of a rotary disc is substantially perpendicular to the opposing face of the rotary disc and extends between the inner and outer diameter of the rotary disc. Each downstream facing drive surface includes a leading end contiguous with the inner diameter and an trailing end contiguous with the outer diameter and is backwardly curving such that a trailing end of the downstream facing drive surface extends away from the outlet relative to the leading end of the downstream facing drive surface. Each upstream facing surface of the rotary disc inclines upwardly from the bottom area to the opposing face of the rotary disc. The width of each upstream facing surface expands as the upstream facing surface extends from the inner to the outer diameter of the rotary disc.

In another preferred embodiment, the opposing faces of each rotary disc include as discontinuities a plurality of evenly spaced radially extending upraised portions, each having a downstream facing drive surface and an upstream facing surface located upstream of the downstream facing drive surface, each of which is substantially perpendicular to the face of the rotary disc. The upraised portions also include an inner surface and an outer surface, both of which are contiguous with a downstream facing drive surface and an upstream surface and which are substantially perpendicular to the face of the rotary disc. The inner surface is positioned outward of the inner diameter of the rotary disc and is substantially perpendicular to the radial component which intersects therewith. The outer surface is positioned inward of the outer diameter of the rotary disc and is substantially perpendicular to the radial component which intersects therewith. The upraised portion also includes a top surface which is substantially parallel to the face of the rotary disc. The width of each top surface expands as the top surface extends from near the inner diameter to near the outer diameter of the rotary disc such that the width of the recess defined by adjacent upraised sections remains constant as the recess extends from near the inner diameter to near the outer diameter of the rotary disc. The upraised portion is backwardly curing such that the outer surface extends away from the outlet relative to the inner surface.

As yet another feature of a preferred embodiment of the present invention, the discontinuities of the opposing rotary discs are aligned to define a symmetric channel for the transport of particulates. As yet one more feature of a preferred embodiment of the present invention described above, the transport duct is further defined by the outer edge of the rotary discs and an exterior arcuate wall stationary during operation with respect to the outer edges of the rotary discs. Alternatively, the arcuate wall may be positioned between the rotary discs, adjustable in its radial distance from the central hub of the apparatus. The wall may also be formed from multiple elements, which can also be adjusted radially inward and outward with respect to the rotary discs to vary the cross-sectional area and therefore the convergence of the transport duct.

As yet another feature of a preferred embodiment of the present invention, means are provided for positioning the second rotary disc at an angle relative to the first rotary disc such that, in rotation, the distance between the opposing faces of the first and second rotary discs adjacent the inlet is greater than the distance between the opposing faces of the first and second rotary discs downstream from the inlet. In this configuration, the cross-sectional area between opposing faces decreases as the rotary discs move from adjacent the inlet towards the outlet thereby providing a convergence or choke in the transport duct.

Alternatively, the disks may be arranged at an angle relative to each other such that the cross-section area between opposing disk faces increases from the inlet toward the outlet (with no decrease in the cross sectional area when viewing the duct from the inlet to the outlet), thereby providing a divergent transport duct. Other embodiments may employ parallel disks which cooperate with the arcuate wall to define a duct having a generally constant cross-sectional area (excluding cross-sectional area changes created by the discontinuities in the opposing disk faces) from the inlet to the outlet.

As an additional feature of a above-described preferred embodiment of the present invention, the angle at which the second rotary disc rotates in the housing can be varied to allow fine tuning of the apparatus for different types of material being transported. Variation of the angle modifies the rate of change of the cross-sectional area between the inlet and the outlet to provide a different convergence or choke in the duct, or a different divergence in the duct, or to provide a constant cross-section duct.

As yet another embodiment of the present invention, the apparatus may include vibrating means adjacent the inlet for facilitating compaction of particulate solids.

As yet one more feature of a preferred embodiment of the present invention described above, the inner faces of the rotary discs are composed of material having substantially non-adhesive properties to facilitate discharge of particulate material at the outlet and to facilitate cleaning of the rotary discs during maintenance.

The uniform and constant flow rate provided by the apparatus in accordance with embodiments of the present invention makes it particularly well suited for both transporting and metering particulate material under a variety of conditions. The volume of particulate material being delivered is conveniently and accurately determined by measuring the rotational speed of the discs and relating this to the cross-sectional area of the duct. During metering operations, conventional monitoring equipment may be included to ensure that the passageway is full of solids during the metering process.

The above discussed and many other features and attendant advantages of the present invention will become better understood by reference to the following detailed description when considered in conjunction with the accompanying drawings.

DETAILED DESCRIPTION OF THE PREFERRED EMBODIMENTS

In accordance with preferred embodiments of the present invention, the apparatus described provides for transporting and metering particulate materials with increased efficiency and reliability. It may be used for transporting a wide range of particulate materials, including both small and large particulates and mixtures of them, having varying degrees of moisture content, under both ambient and pressurized conditions.

Figure 1:
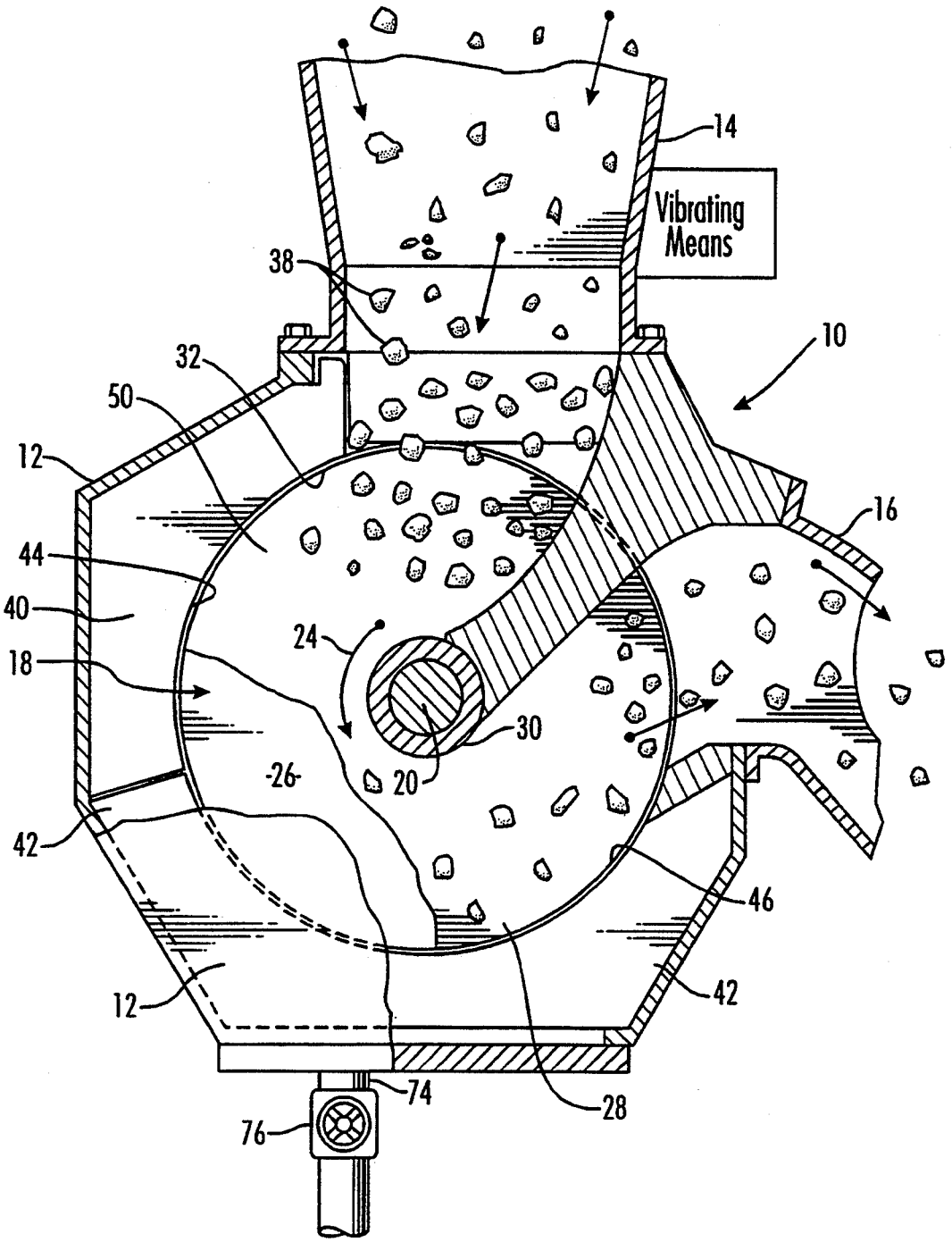
FIG. 1 is a partial sectional side view of a first preferred exemplary apparatus in accordance with an embodiment of the present invention.

A first preferred exemplary apparatus in accordance with an embodiment of the present invention is shown generally at 10 in FIG. 1. The apparatus 10 includes a housing 12, an inlet 14, and outlet 16. Located within housing 12 is drive rotor 18. The drive rotor 18 is mounted on shaft 20, with shaft 20 being rotatably mounted within a conventional low-friction bearing assembly (not shown) for rotation about the axis of shaft 20. The shaft 20 is connected to a hydrostatic or electrically-driven motor (not shown). The shaft 20 is driven by the motor in the direction shown by arrow 24 in FIG. 1.

Figure 2:
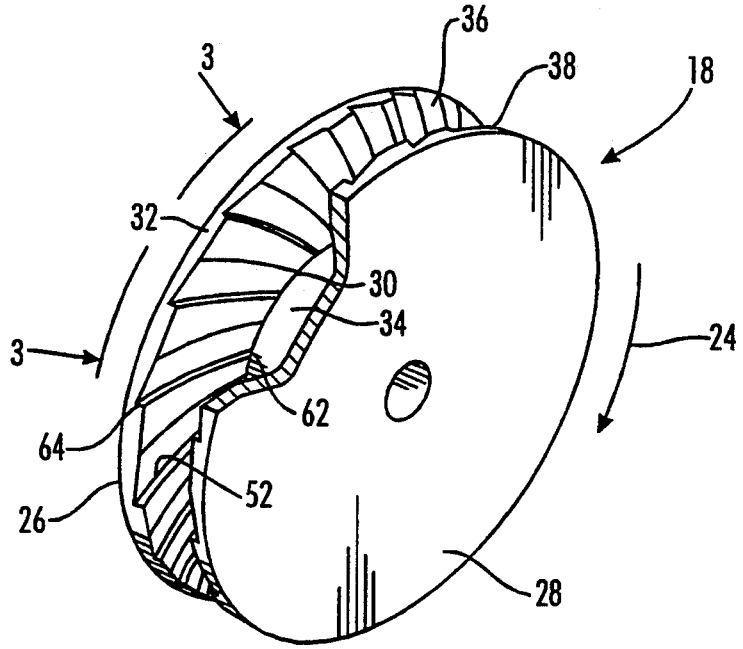
FIG. 2 is a perspective cut away view of the drive rotor of the preferred exemplary apparatus shown in FIG. 1 showing preferred exemplary discontinuities on opposing interior surfaces of parallel rotary discs.
Figure 3:
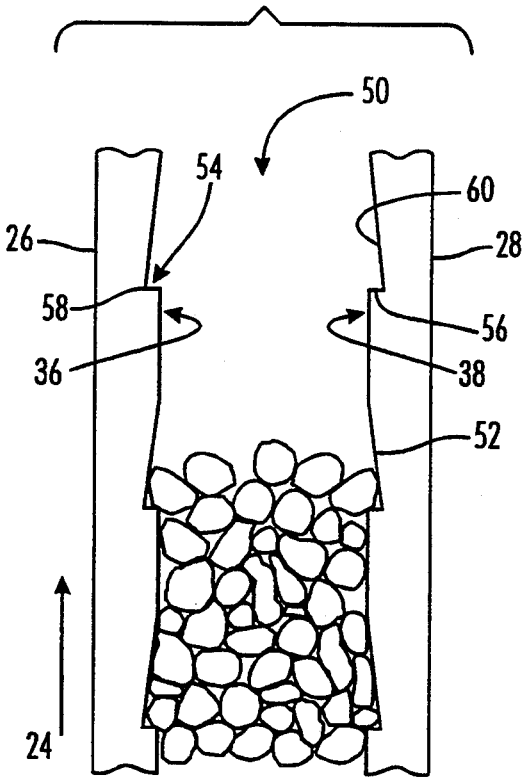
FIG. 3 is a partial sectional transverse view of the drive rotor shown in FIG. 2 taken in the 3—3 plane showing particulates bridged between opposing interior faces of the rotary discs.

As best shown in FIGS. 2 and 3, the drive rotor 18 includes rotary discs 26 and 28, having inner diameters 30 and outer diameters 32, and hub 34. Preferably, the drive rotor is made up of two separate rotary discs in order to facilitate assembly of the solids pump.

Rotary discs 26 and 28 include opposing interior faces 36 and 38. Opposing interior faces 36 and 38 are not planar but rather include a plurality of evenly spaced radially extending discontinuities 52. Each discontinuity 52 defines a transport facilitation zone 54 having a downstream facing drive surface 56, a bottom area 58 and an upstream facing surface 60.

As best shown in FIGS. 2 and 3, downstream facing drive surfaces 56 are perpendicular to interior faces 36 and 38 and backwardly curving such that trailing end 64 extends away from outlet 16 relative leading end 62 as rotary disc 26 moves between inlet 14 and outlet 16. This backwardly curving configuration facilitates discharge of particulates at outlet 16.

In the preferred embodiment shown in FIGS. 2 and 3, the width of transport facilitation zones 54 increase as transport facilitation zones 54 extend from inner diameter 30 to outer diameter 32. Upstream facing surfaces 60 of each rotary disc incline upwardly from bottom area 58 to the interior face of the rotary disc.

Opposing interior faces 36 and 38 are positioned opposite each other in order to provide surfaces between which the particulate solids are compacted. Preferably, the discontinuities 52 of opposing interior faces 36 and 38 are aligned to define a symmetric channel for transport of particulates as best shown in FIG. 3. This symmetric configuration mitigates against uneven loadings on the bearing assembly (not shown) supporting drive rotor 18 during compaction and transport of particulates.

The preferred exemplary apparatus 10 includes one or more exterior shoes such as those shown in FIG. 1 at 40 and 42. The exterior shoes 40 and 42 are designed to close the primary transport channel formed between interior faces 36 and 38 of the drive rotor 18. Each of the exterior shoes 40 and 42 includes a stationary inner wall 44 and 46, respectively. Inner walls 44 and 46, in combination with hub 34 and opposing interior faces 36 and 38, define the cross-sectional area of the primary transport channel 50 at any given point. Both exterior shoes 40 and 42 are mounted to the housing by way of suitable mounting brackets or pins. The inner wall, or inner walls in the case of plural shoes, are accurately formed so as to conform to the circular perimeter of the rotary discs 26 and 28. Therefore, as the rotary discs 26 and 28 rotate with the shaft 20, the stationary wall of the shoe keeps the particulate matter being transported between the opposing interior faces 36 and 38. In one preferred embodiment, the inner wall of the shoe extends axially (transversely of the shoe) beyond interior surfaces 36 and 38, respectively, of the drive rotor 18 so as to overlap the interior surfaces 36 and 38 of the drive rotor. The shoe is placed as close as possible, within acceptable tolerances, to the outer diameters 32 of interior faces 36 and 38. In this configuration, the shoe is not radially adjustable to move closer or further away from the hub 34 of the drive rotor 18 to change the cross-sectional area of the primary transport channel 50.

In an alternative embodiment, the shoe may be axially sized and shaped so as to fit between opposing interior faces 36 and 38 to form a curved outer wall for the primary transport channel 50. In this configuration, the radial location of the shoe may be adjusted toward or away from the hub 34 of the drive rotor 18 so as to change the cross-sectional area of the primary transport channel 50. For this purpose, a screw adjuster may be connected to one or a plurality of shoes as shown in U.S. Pat. No. 4,988,239 (incorporated herein by reference). The screw adjuster shown in the '239 patent provides radially inward and outward adjustment of shoe 40 about a pin. The inward and outward adjustment of shoe 40 allows setting up a choking or compaction of the solids as they move through the pump or, alternatively, to provide a diverging or a constant cross-sectional area along duct. A second screw adjuster may be attached to a second shoe 42 shown in the '239 patent. The second screw adjuster is of the same type as the first and is provided to allow inward and outward radial adjustment of shoe 42. The inward and outward adjustment of shoe 42 would allow the size of the duct to be varied as the solids move through the pump after passing the first shoe 40 substantially independently of the angle of the second disc 26. In further embodiments, a single stationary wall may be provided, instead of the shoes 40 and 42 and shoe walls 44 and 46.

Figure 6:
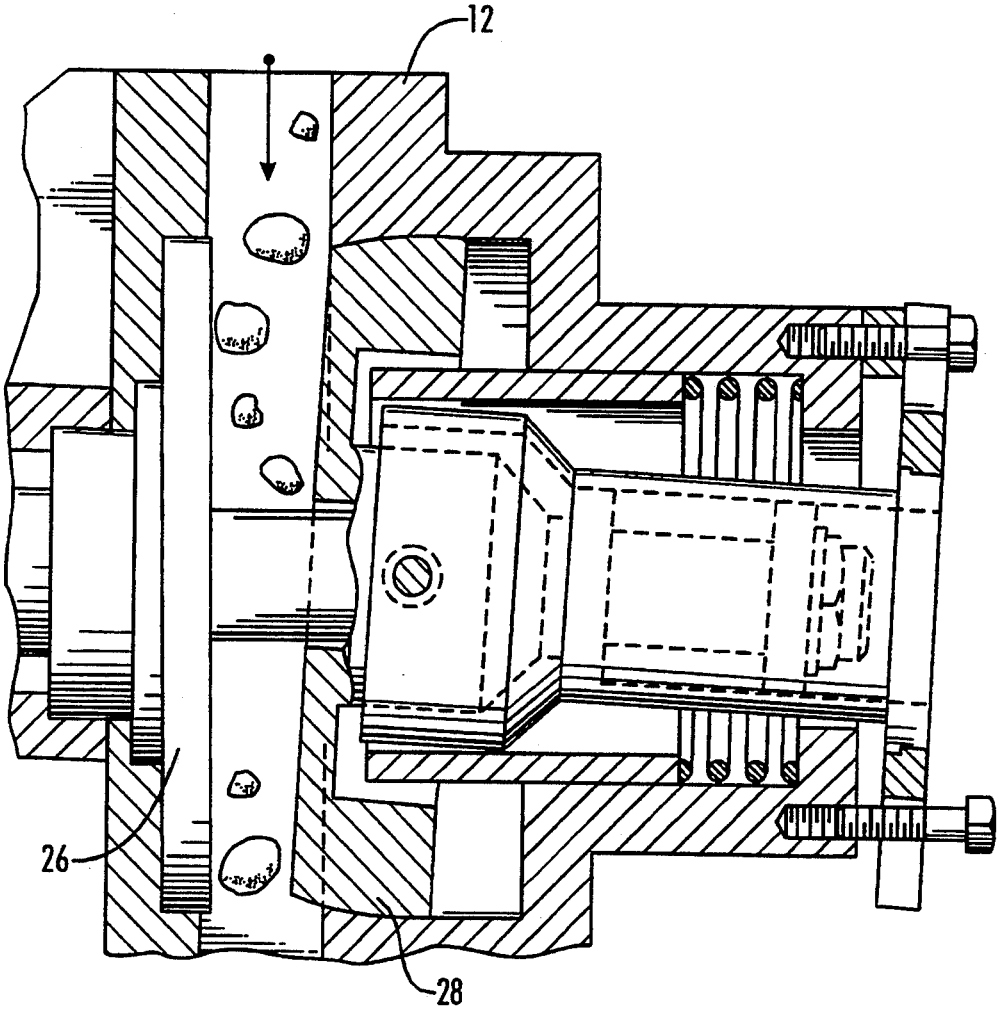
FIG. 6 is a partial transverse sectional view of an embodiment of a mechanism for supporting one disk at an angle relative to the other.

In a preferred embodiment of the present invention (not shown), compaction of articulates is accomplished by providing means for positioning rotary disc 26 at an angle relative to rotary disc 28 such that the distance between the opposing interior faces 36 and 38 adjacent the inlet 14 is greater than the distance between opposing interior faces 36 and 38 downstream from inlet 14 between inlet 14 and outlet 16. (Alternatively, the disks may be angled relative to each other to define a diverging duct from the inlet to the outlet.) In this configuration, the cross-sectional area of the transport duct decreases (or increases, in the diverging embodiment) as the distance between the opposing interior faces decreases (or increases) thereby providing a convergence or choke (or divergence) in the transport duct. Preferably, means are also included to vary the angle at which the rotary discs rotates relative to each other. An embodiment of a mechanism for supporting one rotary disk at an angle relative to the other is shown FIG. 6. Variation of the angle modifies the rate of change of the cross-sectional area between the inlet and the outlet to provide a different convergence or choke (or divergence) in the duct. Various aspects of the foregoing and alternative preferred arrangements for accomplishing compaction are more fully described in U.S. patent application Ser. No. 07/929,880 which is incorporated herein by this reference.

In another preferred embodiment of the present invention (not shown), means for vibrating particulate material adjacent inlet 14 are provided to facilitate compaction. In some applications, the use of vibrating means at inlet 14 may provide sufficient compaction for pump operation. In other applications, the pressure head developed by gravitational forces exerted on particulates at inlet 14 may provide sufficient compaction for operation of the pump in which case no additional compaction would be necessary.

As best shown in FIG. 3, the compaction of particulate material results in the formation of a transient solid or bridge composed of substantially abutting or interlocking particulates spanning the width of primary transport channel 50 and including particulates compacted within transport facilitation zones 54. The bridge of particulates is engaged by downstream facing drive surfaces 56 upon rotation of rotary discs 26 and 28 and transported towards outlet 16.

Figure 5:
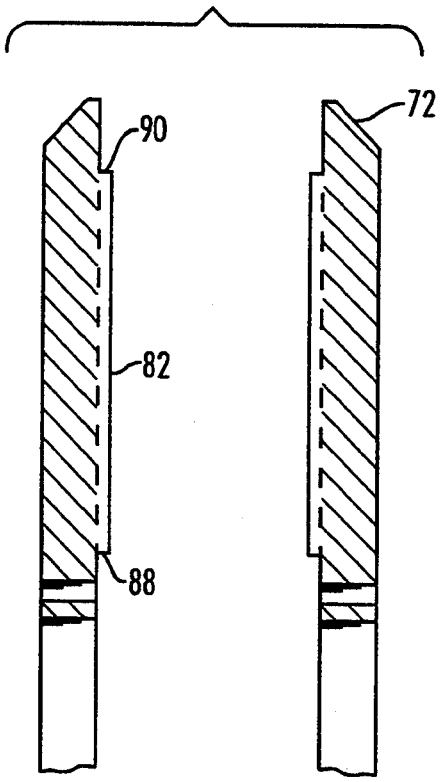
FIG. 5 is a partial sectional transverse view of the rotary disc shown in FIG. 4 taken in the 5—5 plane.

In order to preclude particulates and particulate dust from wedging in the space defined between the housing 12 and the outer edge of each rotary disc 26 and 28, the rotary discs include a chamfer 72 as best shown in FIG. 5 which inclines away from housing 12 as the outer edge extends outward from the interior face of the rotary disc. Preferably, the outer edge is chamfered at an angle of about 45 degrees.

A dust drain 74 with an associated valve 76 is provided at the bottom of the housing for allowing removal of dust which may accumulate during pump operation. The valve 76 may be left open during pump operation to continually remove dust as it falls into the drain through an interior collection channel (not shown). Alternatively, the valve 76 may be left closed, and only opened when the interior collection channel has filled with dust. The opening and closing of the valve 76 will, of course, depend upon the dustiness or friability of the particular solid material being transported.

The size of the drive rotor 18 may vary widely, depending upon the type and volume of material which is to be transported or metered. Typically, outside diameters for the rotary discs 26 and 28 may range from a few inches to many feet. The smaller rotary discs are well suited for use in transporting and metering relatively small volumes of solid material such as food-additives and pharmaceuticals. The larger size discs may be utilized for transporting and metering large amounts of both organic and inorganic solid materials, including food stuffs, coal, gravel and the like. The apparatus is equally well suited for transporting and metering large and small particles and mixtures of them, and large and small volumes, and may be used to transport and meter both wet and dry particulate material with the only limitation being that the material cannot be so wet that viscous forces dominate so as to disturb bridging.

Figure 4:
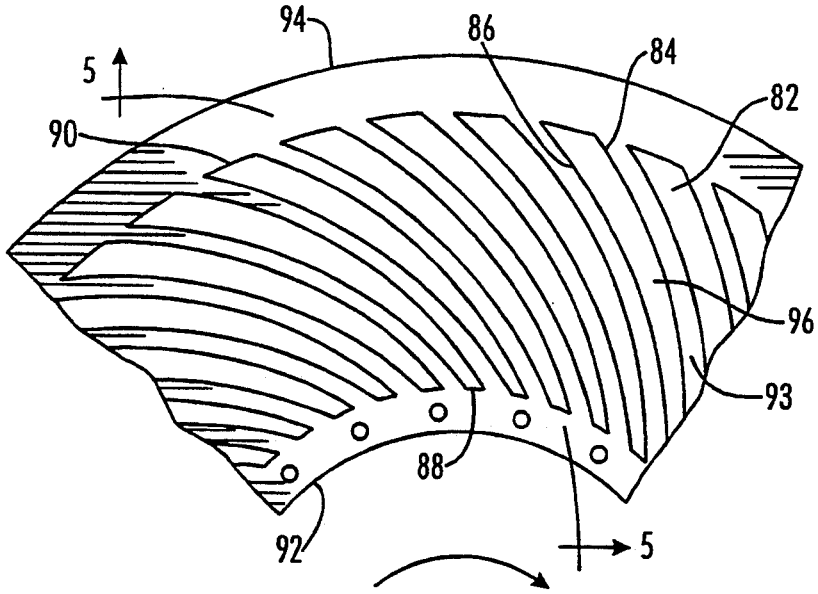
FIG. 4 is a plan view of a second preferred exemplary rotary disc.

The configuration of discontinuities on the opposed interior surfaces 36 and 38 may vary substantially in accordance with the present invention. In the preferred embodiment of rotary discs shown in FIGS. 4 and 5, the opposing interior faces 36 and 38 of each rotary disc include as discontinuities a plurality of evenly spaced radially extending upraised portions 82, each having a downstream facing drive surface 84 and an upstream facing surface 86 located upstream of the downstream facing drive surface 84, each of which is substantially perpendicular to the interior face of the rotary disc. The upraised portions 82 also include an inner surface 88 and an outer surface 90, both of which are contiguous with a downstream facing drive surface 84 and an upstream facing surface 86 and which are substantially perpendicular to the interior face of the rotary disc. The inner surface 88 is positioned outward of the inner diameter 92 of the rotary disc and is substantially perpendicular to the radial component which intersects therewith. The outer surface 90 is positioned inward of the outer diameter 94 of the rotary disc and is substantially perpendicular to the radial component which intersects therewith. The upraised portion 82 also includes a top surface 96 which is substantially parallel to the interior face of the rotary disc. The width of each top surface 96 expands as the top surface 96 extends from near the inner diameter 92 to near the outer diameter 94 of the rotary disc such that the width of the recess 98 defined by adjacent upraised sections 82 remains constant as the recess 98 extends from near the inner diameter 92 to near the outer diameter 94. The upraised portion 82 is backwardly curving such that the outer surface 90 extends away from outlet 16 relative to inner surface 88 as the rotary disc moves between inlet 14 and outlet 16.

Alternatively, opposing interior faces may include radially extending undulations defining a wave-like series of alternating crests and troughs. Further embodiments may employ curved simple straight ridges or grooves in the disk walls.

The apparatus in accordance with the present invention may be utilized for transporting particulate material against atmospheric pressure. In addition, the pump has been found useful in pumping solids into pressurized systems (e.g., wherein the pressure at the outlet side of the apparatus is greater than the pressure at the inlet side of the apparatus). Referring to FIGS. 1 and 2, it is preferred when pumping solids into pressurized systems that the entire cross-sectional area of outlet 16 be filled with solids during pumping. This forms a dam at the pump outlet which is a barrier to possible deleterious effects of reverse flow of gases, liquids or solids back into the pump through the outlet. The cumulative bridging of the particulates provides a sequentially formed cascaded reinforcement which adds strength to the particle bridge portions closer to the outlet, such that the bridge portions closer to the outlet will be strong enough to withstand the higher pressure at the outlet side of the apparatus. The duct length is preferably designed such that a sufficient amount of cumulative, cascaded bridging occurs in the duct to support and withstand the higher pressure at the outlet side of the pump. This can be accomplished with a convergent duct, constant cross-section duct or divergent duct system. It is interesting to note that prior to the present invention, it was not believed to be practical or possible to pump solids into a higher pressure outlet side with a divergent duct system.

Although the preferred exemplary embodiments have been shown utilizing a single drive rotor, it is also possible to provide transport apparatus having multiple drive rotors which receive material from a single or multiple inlets. The use of multiple drive rotors provides for increased material through-put without having to increase the diameter of the rotor disc.

Once the pump is set up for operation, adjustments of the shoe position should not be necessary. If jamming of the pump does occur, the right drive disc may be conveniently removed. This provides immediate access to the passageway to allow quick clean out of any blockage.

The bridging of solids results in a positive displacement of the solids. Accordingly, the pump may be used both as a transport and metering device. Due to the positive displacement of solids through the pump, metering is accomplished by measuring the rate of rotation of the drive rotor and calculating the amount of solids flow through the pump based upon the cross-sectional area of the duct at its narrowest point. When used as a metering pump, it is desirable that some type of conventional detection device be utilized to ensure that the passageway remains full of solids at all times during solids metering. Such conventional detection devices include gamma ray and electro-mechanical detectors. These detectors are all well known in the art and are neither shown in the drawings nor described in detail.

The degree to which the particulate material are compacted will vary widely depending upon the materials being conveyed, pump rotation speed and whether or not the solids are being pumped against a pressure head.

The apparatus elements are preferably made of high strength steel or other suitable material. The interior surfaces of drive discs and the interior walls of the shoes are preferably made of an abrasion-resistant metal or other suitable material having non-adhesive qualities to facilitate discharge at the outlet during operation and to facilitate cleaning during maintenance. In suitable applications, the interior surfaces of the rotary discs and the interior wall of the shoes may be composed of a material such as polytetrafluoroethylene.

The apparatus according to embodiments of the present invention is also well suited for metering slugs or plugs of solid material into a flowing pipeline system or other system where discrete repetitive introduction of material is required. The accurate control of transport and metering which is achieved allows pulsed delivery of discrete amounts of particulate material into both pressurized and unpressurized systems.

Having thus described exemplary embodiments of the present invention, it should be understood by those skilled in the art that the above disclosures are exemplary only and that various other alternatives, adaptations and modifications may be made within the scope of the present invention. For example, although a drive rotor is a preferred form of a moving surface, it is not essential. Any type of conveyor belt or other system may be utilized so long as the bridging and a downstream facing drive surface features are provided. Accordingly, the present invention is not limited to the specific embodiments as illustrated herein, but is only limited by the following claims.

What is claimed is:

1. An apparatus for transporting particulate material comprising:

a transport duct having an inlet and an outlet downstream of said inlet, and a primary transport channel located between said inlet and said outlet, said primary transport channel being defined by a pair of opposed moving surfaces which move between said inlet and said outlet towards said outlet, at least one of said moving surfaces having a series of discontinuities, each of said discontinuities configured to define a transport facilitation zone contiguous with said primary transport channel such that particulate material within said transport facilitation zone is contiguous with particulate material within said primary transport channel, each of said discontinuities having a downstream facing drive surface;

motive means for moving said movable surfaces between said inlet and said outlet towards said outlet.

2. An apparatus for transporting particulate material according to claim 1 wherein said downstream facing drive surface is substantially perpendicular to said first moving surface.

3. An apparatus for transporting particulate material according to claim 1 wherein said pair of moving surfaces are configured to define a substantially symmetric channel within said transport duct.

4. An apparatus for transporting particulate material according to claim 1 wherein said pair of moving surfaces comprises a first face of a first rotary disc and a second face of a second rotary disc and said primary transport channel is further defined by at least one arcuate wall extending between said inlet and said outlet.

5. An apparatus for transporting particulate material according to claim 4 wherein said first face has an inner section and an outer section and said downstream facing drive surface extends from said inner section to said outer section.

6. An apparatus for transporting particulate material according to claim 5 wherein said down stream facing drive surface is arcuate and has a leading end located on said inner section of said first face and a trailing end located on said outer section of said first face, said trailing end extending away from said outlet relative to said leading end.

7. An apparatus for transporting particulate material according to claim 6 wherein the width of said transport facilitation zone increases as said transport facilitation zone extends from said inner section to said outer section.

8. An apparatus for transporting particulate material according to claim 7 wherein said downstream facing drive surface is substantially perpendicular to said first face.

9. An apparatus for transporting particulate material according to claim 4 wherein said compacting means further comprises means for positioning said second rotary disc at an angle relative to said first rotary disc such that, in rotation, the distance between said first and second faces adjacent said inlet is greater than the distance between said first and second faces downstream from said inlet between said inlet and said outlet.

10. An apparatus for transporting particulate material according to claim 9 wherein said compacting means further comprises means for adjusting the angle of said second rotary disc relative to said first rotary disc.

11. An apparatus for transporting particulate material according to claim 1 wherein said compacting means further comprises means for vibrating said particulates.

12. An apparatus for transporting particulate material according to claim 11 wherein said vibrating means is positioned adjacent said inlet.

13. An apparatus for transporting particulate material according to claim 1 wherein said transport duct is composed of substantially non-adhesive material.

14. An apparatus for transporting particulate material comprising:

a transport duct having an outlet downstream of said inlet, and a primary transport channel located between said inlet and said outlet, said primary transport channel being defined by at least a first moving surface which moves between said inlet and said outlet towards said outlet, said first moving surface having at least one discontinuity configured to define a transport facilitation zone contiguous with said primary transport channel such that particulate material within said transport facilitation zone is contiguous with particulate material within said primary transport channel, said discontinuity having a downstream facilitating drive surface;

motive means for moving said first moving surface between said inlet and said outlet towards said outlet;

wherein said downstream facing drive surface is substantially perpendicular to said first moving surface; and wherein each of said discontinuities further comprises an upstream facing surface located downstream of said downstream facing drive surface and a bottom surface contiguous with said downstream and upstream facing surfaces, said upstream facing surface inclining upwardly from said bottom surface to said first moving surface.

15. An apparatus for transporting particulate material comprising:

a transport duct having an inlet and an outlet downstream of said inlet, and a primary transport channel located between said inlet and said outlet, said primary transport channel being defined by at least a first moving surface which moves between said inlet and said outlet towards said outlet, said first moving surface having at least one discontinuity configured to define a transport facilitation zone contiguous with said primary transport channel such that particulate material within said transport facilitation zone is contiguous with particulate material within said primary transport channel, said discontinuity having a downstream facing drive surface;

motive means for moving said first moving surface between said inlet and said outlet towards said outlet;

wherein said primary transport channel is further defined by a second moving surface substantially opposed to said first moving surface which moves between said inlet and said outlet towards said outlet;

wherein said pair of moving surfaces further comprises a first face of a first rotary disc and a second face of a second rotary disc and said primary transport channel is further defined by at least one arcuate wall extending between said inlet and said outlet;

wherein said first face has an inner section and an outer section and said downstream facing drive surface extends from said inner section to said outer section;

wherein said down stream facing drive surface is arcuate and has a leading end located on said inner section of said first face and a trailing end located on said outer section of said first face, said trailing end extending away from said outlet relative to said leading end;

wherein the width of said transport facilitation zone increases as said transport facilitation zone extends from said inner section to said outer section;

wherein said downstream facing drive surface is substantially perpendicular to said first face;

wherein each of said discontinuities further comprise an upstream facing surface located downstream of said downstream facing drive surface and a bottom surface contiguous with said downstream and upstream facing surfaces, said upstream facing surface inclining upwardly from said bottom surface to said first face.

16. An apparatus for transporting particulate material according to claim 15 wherein said pair of moving surfaces are configured to define a substantially symmetric channel within said transport duct.

17. An apparatus for transporting particulate material comprising:

a housing having an inlet and an outlet spaced downstream from said inlet;

a transport duct enclosed within said housing between said inlet and said outlet having a primary transport channel, said primary transport channel being defined by first and second rotary discs movable relative to said housing between said inlet and said outlet towards said outlet and at least one arcuate wall extending between said inlet and said outlet, said first rotary disc having a first face, said second rotary disc having a second face which substantially opposes said first face, at least one of said first and second faces having a series of discontinuities, each of said discontinuities configured to define first and second transport facilitation zones contiguous with said primary transport channel such that particulate material within said first and second transport facilitation zones are contiguous with particulate material within said primary transport channel; and motive means for moving said first and second rotary discs between said inlet and said outlet towards said outlet.

18. An apparatus according to claim 17, further comprising means for compacting said particulate material efficiently to cause the formation of a transient solid composed of particulate material located within said first and second transport facilitation zones and particulate material located within said primary transport channel.

19. An apparatus according to claim 18, wherein the cross-sectional area of said transport duct generally increases in the direction from the inlet to the outlet.

20. An apparatus for transporting particulate material comprising:

a housing having an inlet and an outlet spaced downstream from said inlet;

first and second opposed movable surfaces spaced apart from each other to define a particulate material transport channel therebetween, said transport channel being in particulate flow communication with said inlet and said outlet, said first and second movable surfaces being movable relative to said housing between said inlet and said outlet towards said outlet, at least one of said first and second surfaces having a series of discontinuities; and a driver coupled to drive said first and second surfaces between said inlet and said outlet towards said outlet.

21. An apparatus according to claim 20, wherein the cross-sectional area of said transport channel generally increases in the direction from the inlet to the outlet.

22. An apparatus according to claim 20, wherein each of said first and second surfaces has said series of discontinuities.

23. An apparatus according to claim 20, further comprising at least one arcuate wall extending between said inlet and said outlet and bordering said transport channel.

24. An apparatus according to claim 20, wherein said first and second surfaces are the disc face surfaces of a pair of rotary discs.

25. An apparatus according to claim 20 wherein each of said discontinuities is configured to define a transport facilitation zone contiguous with said primary transport channel such that particulate material within said transport facilitation zone is contiguous with particulate material within said primary transport channel.

* * * * *